US008746203B2

(12) United States Patent
Nakamura

(10) Patent No.: US 8,746,203 B2
(45) Date of Patent: Jun. 10, 2014

(54) LUBRICATION APPARATUS FOR FOUR-STROKE ENGINE

(71) Applicant: Yuki Nakamura, Shizuoka (JP)

(72) Inventor: Yuki Nakamura, Shizuoka (JP)

(73) Assignee: Makita Corporation, Aichi (JP)

( * ) Notice: Subject to any disclaimer, the term of this patent is extended or adjusted under 35 U.S.C. 154(b) by 0 days.

(21) Appl. No.: 13/665,995

(22) Filed: Nov. 1, 2012

(65) Prior Publication Data

US 2013/0118440 A1 May 16, 2013

(30) Foreign Application Priority Data

Nov. 14, 2011 (JP) ..... 2011-248768

(51) Int. Cl.
*F01M 1/04* (2006.01)

(52) U.S. Cl.
USPC ..... 123/196 CP

(58) Field of Classification Search
USPC ..... 123/196 P
See application file for complete search history.

(56) References Cited

U.S. PATENT DOCUMENTS 5,709,185 A 1/1998 Aizawa et al.
5,960,764 A * 10/1999 Araki ..... 123/196 R
6,681,737 B2 * 1/2004 Shinoda et al. ..... 123/196 R
6,769,391 B1 * 8/2004 Lee et al. ..... 123/196 R
7,624,714 B2 * 12/2009 Kurihara et al. ..... 123/196 M
2007/0089692 A1 * 4/2007 Kochi et al. ..... 123/41.7
2008/0083392 A1 4/2008 Kurihara et al.
2009/0014246 A1 * 1/2009 Lin ..... 184/6.5
2009/0084342 A1 * 4/2009 Henglin ..... 123/196 CP
2009/0283067 A1 * 11/2009 Kurihara et al. ..... 123/196 A
2011/0067659 A1 3/2011 Sugiyama et al.

FOREIGN PATENT DOCUMENTS

EP 2 305 973 4/2011
JP 2007-224824 9/2007

* cited by examiner

*Primary Examiner* — Lindsay Low
*Assistant Examiner* — Charles Brauch
(74) *Attorney, Agent, or Firm* — Greenblum & Bernstein P.L.C.

(57) ABSTRACT

A lubrication apparatus for a four-stroke engine includes a piston, a cylinder, a crank chamber and a valve operating chamber. The lubrication apparatus configured to lubricate driving parts while circulating oil mist through an oil circulation pathway, using pressure fluctuation in the crank chamber, the pressure fluctuation being caused by reciprocating motion of the piston. The lubrication apparatus further includes a direct passageway configured to allow communication between the valve operating chamber and the crank chamber when a negative pressure is created in the crank chamber. The direct passageway includes a flexible tube part that is formed out of the cylinder.

5 Claims, 2 Drawing Sheets

B

A

LUBRICATION APPARATUS FOR FOUR-STROKE ENGINE

CROSS-REFERENCES TO RELATED APPLICATIONS

This application claims the benefit of Japanese Patent Application No. 2011-248768, filed on Nov. 14, 2011, the entire contents of which are incorporated herein by reference.

BACKGROUND

1. Technical Field

The present invention relates to a lubrication apparatus for a four-stroke engine mounted in a portable working machine such as a brush cutter, a hedge trimmer and so forth. In the general meaning, a portable engine for a backpack working machine may be a kind of four-stroke engines.

2. Related Art

A lubrication apparatus for a four-stroke engine disclosed, for example, in Japanese Patent Application No. 2007-224824 has been known. In a lubrication apparatus for general four-stroke engines, a lubricating passageway is formed mainly in a cylinder block in order to reduce a four-stroke engine in size and weight.

When the lubricating passageway is formed in a cylinder near a combustion chamber, the oil flowing through the lubricating passageway may be heated more than necessary. If the oil heated excessively is supplied to a crank chamber, lubrication failure is likely to occur. In addition, the thickness of a cylinder block is increased by forming the lubricating passageway in the cylinder block, and rather this prevents the four-stroke engine from reducing its weight. Moreover, it is difficult to fabricate a long hole precisely in the thick portion of a cylinder block using a drill and so forth. This causes a drop in fabrication yield.

SUMMARY

It is therefore an object of the present invention to provide a lubrication apparatus for a four-stroke engine configured to prevent lubricating oil from increasing in temperature, improve the freedom of the arrangement of a lubricating passageway, and improve its productivity.

In order to solve the above-described problems, a first aspect of the present invention provides a lubricating apparatus for a four-stroke engine including: a piston; a cylinder; a crank chamber; and a valve operating chamber. The lubrication apparatus configured to lubricate driving parts while circulating oil mist through an oil circulation pathway, using pressure fluctuation in the crank chamber, the pressure fluctuation being caused by reciprocating motion of the piston. The lubrication apparatus further includes a direct passageway configured to allow communication between the valve operating chamber and the crank chamber when a negative pressure is created in the crank chamber. The direct passageway includes a flexible tube part that is formed out of the cylinder.

According to a second aspect of the present invention, L-shaped pipe lines are provided at both ends of the tube part, respectively.

According to a third aspect of the present invention, an opening of the direct passageway in the crank chamber opens when the piston moves from a position near a top dead center to the top dead center, and closes when the piston moves from a position near the top dead center to a bottom dead center.

According to a fourth aspect of the present invention, the tube part of the direct passageway is formed between the cylinder and an air guiding cover configured to guide cooling air to cool the cylinder.

According to a fifth aspect of the present invention, further includes: a gas-liquid separator configured to separate oil mist from blowby gas; and a reflux passageway configured to flow oil separated in the gas-liquid separator back to the crank chamber. An opening of the reflux passageway in the crank chamber opens when the piston moves from a position near the top dead center to the top dead center, and closes when the piston moves from a position near the top dead center to the bottom dead center.

With the present invention, it is possible to provide a lubrication apparatus for a four-stroke engine configured to prevent lubricating oil from increasing in temperature, improve the freedom of the arrangement of a lubricating passageway, and improve its productivity.

DESCRIPTION OF EXEMPLARY EMBODIMENTS

Hereinafter, a lubrication apparatus for a four-stroke engine according to an embodiment of the present invention will be explained with reference to FIG. 1, FIG. 2A and FIG. 2B. The lubrication apparatus is designed to be mounted in a four-stroke engine, and therefore a four-stroke engine including this lubrication apparatus will be explained with reference to FIG. 1.

Figure 1:
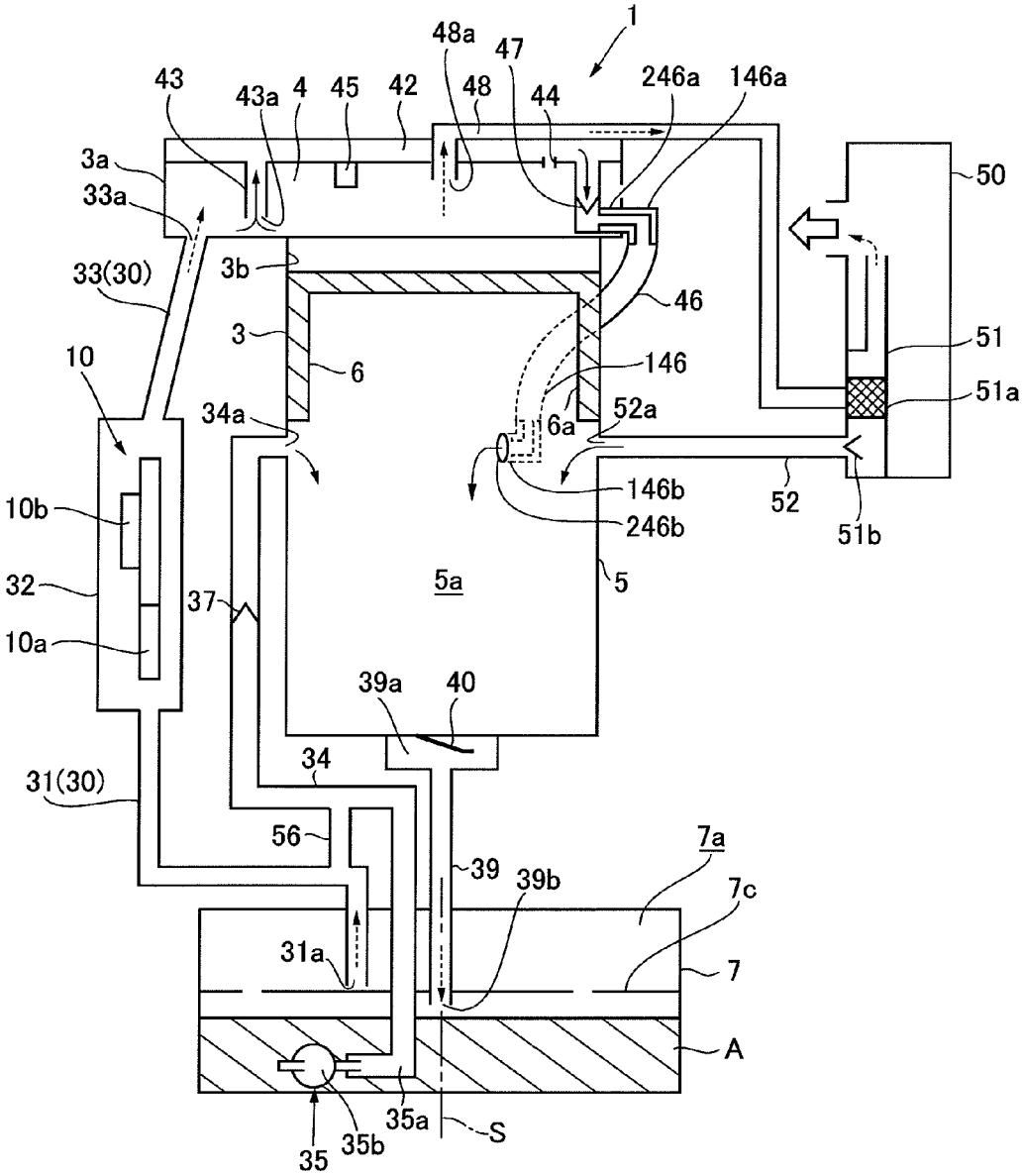
FIG. 1 is a schematic view showing a four-stroke engine including a lubrication apparatus according to the present invention.

Here, FIG. 1 shows the four-stroke engine when a piston is located in the top dead center.

As shown in FIG. 1, a four-stroke engine 1 includes: a cylinder block 3 formed integrally with a cylinder head 3*a;* a crankcase 5 which is mounted to the lower part of the cylinder block 3 and constitutes a crank chamber 5*a;* and an oil reservoir 7 provided below the crankcase 5.

The oil reservoir 7 is provided separately from the crankcase 5 and accumulates lubricating oil (hereinafter referred to as "oil A").

A crankshaft (not shown) is rotatably supported in the connecting portion between the cylinder block 3 and the crankcase 5. A piston 6 is connected to the crankshaft via a counterweight and a connecting rod and so forth coupled with the counterweight. The piston 6 is slideably inserted in the cylinder 3*b* in the cylinder block 3.

An intake port and an exhaust port are provided on the upper wall of the cylinder 3*b* in the cylinder block 3. The intake port and the exhaust port communicate with a carburetor (not shown) and an exhaust muffler (not shown), respectively, and have an intake valve and an exhaust valve to open and close the respective ports.

Here, the four-stroke engine 1 according to the present embodiment may be carried by the user in use. In this case, the four-stroke engine 1 may turn over on a temporary basis in use.

A valve operating mechanism 10 drives the above-described valves and includes parts such as a valve driving gear 10*a* firmly fixed to the crankshaft, a cam gear 10*a* driven by the valve driving gear 10*a*, to which a cam is connected, and a rocker arm (not shown).

The valve driving gear 10*a* and the cam gear 10*b* of the valve operating mechanism 10 are accommodated in a valve driving chamber 32. This valve driving chamber 32 is provided on the way of a supply passageway 30 that allows communication between the valve operating chamber 4 formed in the head of the cylinder block 3 and the oil reservoir 7. Meanwhile, the other parts of the valve operating mechanism 10, such as the rocker arm and so forth, are provided in the valve operating chamber 4. Here, the supply passageway 30 is formed by a valve operating mechanism-supply passageway 31 and a push rod passageway 33.

An oil feeding passageway 34 is provided between the oil reservoir 7 and the cylinder block 3. An intake part 35 is mounted at the end of the oil feeding passageway 34 in the oil reservoir 7 side. The intake part 35 has a tubular body 35*a* which is made of an elastic material such as rubber and is easily flexible, and a weight 35*b* with an intake port mounted on the tip of the tubular body 35*a*. This weight 35*b* in the intake part 35 is mounted to be able to move downward in a vertical direction by gravity. Therefore, even if the oil reservoir 7 is tilted, it is possible to place the suction port of the intake part 35 below the level of the oil A accumulated within a prescribed amount.

The oil feeding passageway 34 serves to allow communication between the crank chamber 5*a* and the oil reservoir 7 to suck up the oil A from the oil reservoir 7 and supplies the oil A into the crank chamber 5*a* when the pressure in the crank chamber 5*a* tends to be a negative pressure because the piston 6 moves upward.

An opening 34*a* of the oil feeding passageway 34 which is open in the crank chamber 5 is positioned such that the opening 34*a* opens as the piston 6 moves from a position near the top dead center to the top dead center. In other words, the opening 34*a* is positioned to open when the skirt part 6*a* which is the lower part of the piston 6 passes over the opening 34*a*. Therefore, the opening 34*a* of the oil feeding passageway 34 has already been fully open at the time the piston 6 arrives at the top dead center. Here, when a negative pressure is created in the crank chamber 5*a*, the oil feeding passageway 34 and the crank chamber 5*a* may communicate with one another, by, for example, providing a reed valve in the opening 34*a* of the oil feeding passageway 34, or providing a passageway in the crankshaft to function as a rotary valve.

A check valve 37 is provided on the way of the oil feeding passageway 34. This check valve 37 is configured to open and close in response to pressure fluctuation in the crank chamber 5*a*. To be more specific, the check valve 37 opens when the pressure in the crank chamber 5*a* is lower than the pressure in the oil reservoir 7 to allow the oil feeding passageway 34 to communicate with the crank chamber 5*a*, and closes when the pressure in the crank chamber 5*a* is higher than in the oil reservoir 7.

A communicating passageway 56 allows communication between the valve operating mechanism-supply passageway of the supply passageway 30 and the oil feeding passageway 34. By this means, when a negative pressure is created in the crank chamber 5*a*, part of the oil passing through the valve operating mechanism-supply passageway 31 of the supply passageway 30 is supplied to the oil feeding passageway 34 to prevent oil from being oversupplied to the supply passageway 30.

A communicating passageway 39 is provided between the bottom of the crank chamber 5*a* and the oil reservoir 7 to allow communication between the crank chamber 5*a* and the oil reservoir 7. This communicating passageway 39 serves to supply oil mist produced in the crank chamber 5*a* and oil resulting from liquefying the oil mist, to the oil reservoir 7.

A reed valve 40 is provided in an opening 39*a* of the communicating passageway 39, which is open in the crank chamber 5*a*. This reed valve 40 is configured to be able to open and close in response to pressure fluctuation in the crank chamber 5*a*. To be more specific, the reed valve 40 opens because a positive pressure is created in the crank chamber 5*a* when the piston 6 moves to the bottom dead center, and therefore allows the communicating passageway 39 to communicate with the crank chamber 5*a*.

Therefore, when the reed valve 40 opens to allow the communicating passageway 39 to communicate with the crank chamber 5*a*, the oil mist and the oil in the crank chamber 5*a* are supplied to the oil reservoir 7 through the communicating passageway 39.

A special part 7*b* in the oil reservoir 7 is separated by a baffle plate 7*c* that also functions as a gasket. An opening 31*a* of the valve operating mechanism-supply passageway 31 of the supply passageway 30 is formed above the baffle plate 7*c*. Here, the baffle plate 7*c* is not indispensable.

An opening 39*b* of the communicating passageway 39 in the oil reservoir 7 is open in approximately the center in the oil reservoir 7. This opening 39 is positioned above the level of the oil A accumulated in an amount equal to or smaller than a prescribed amount, regardless of how the oil reservoir 7 is tilted.

Therefore, the oil mist discharged from the opening 39*b* of the communicating passageway 39 is returned gently into the oil A in the oil reservoir 7. By this means, it is possible to return the oil mist to the oil reservoir 7 gently without agitating the oil in the oil reservoir 7, and liquefy most of the oil mist. However, part of the oil mist discharged from the opening 39*b* rebounds from the surface of the oil A or the surface of the wall and remains in the special part 7*a* in the oil reservoir 7 above the level of the oil A. In this way, the opening 39*b* of the communicating passageway 39 placed above the level of the oil A functions as part of a liquefying means. Therefore, most of the oil mist discharged from the communicating passageway 39 is liquefied, and therefore it is possible to reduce the concentration of the oil mist accumulated in the oil reservoir 7.

The opening 31*a* of the valve operating mechanism-supply passageway 31 of the supply passageway 30 is open in approximately the center in the inner space of the oil reservoir 7. This opening 31*a* is arranged not to be positioned below the level of the oil A even if the oil reservoir 7 is tilted and the level of the oil A accumulated within a prescribed amount varies. Moreover, as shown in FIG. 1, the opening 39*b* of the communication passageway 39 extends more than the opening 31*a* of the valve operating mechanism-supply passageway 31 of the supply passageway 30.

In this way, the arrangement is adopted where the opening 39*b* of the communicating passageway 39 extends more than the opening 31*a* of the valve operating mechanism-supply passageway 31 of the supply passageway 30 into the oil reservoir 7. By this means, it is possible to prevent the oil mist discharged from the opening 39*b* of the communicating passageway 39 from directly entering the opening 31*a* of the valve operating mechanism-supply passageway 31 of the supply passageway 30. More preferably, another exemplary configuration is possible where the communicating passageway 39 and the valve operating mechanism-supply passageway 31 of the supply passageway 30 may be arranged such that the distance between the communicating passageway 39 and the valve operating mechanism-supply passageway 31 increases in the direction of the openings.

That is, the oil mist discharged from the communicating passageway 39 does not directly enter the opening 31*a* of the valve operating mechanism-supply passageway 31 of the supply passageway 30, as long as the opening 31*a* is placed in the base end side of the communicating passageway 39 with respect to the plane of the opening 39*b* orthogonal to the direction (indicated by a dashed line) in which the communicating passageway 39 extends.

That is, with the arrangement of the valve operating mechanism-supply passageway 31 of the supply passageway 30 and the communicating passageway 39 in the oil reservoir 7, it is possible to prevent the oil mist discharged from the communicating passageway 39 from flowing directly into the opening 31*a* of the valve operating mechanism-supply passageway 31 of the supply passageway 30.

Therefore, the concentration of the oil mist flowing through the valve operating mechanism-supply passageway 31 of the supply passageway 30 is lower than that of the oil supplied from the oil feeding passageway 34 into the crank chamber 5*a*.

The opening 33*a* of the supply passageway 30 in the valve operating chamber 4 side opens in the valve operating chamber 4 in the cylinder block 3 side. Therefore, the oil mist flowing through the valve operating mechanism-supply passageway 31 of the supply passageway 30 lubricates the valve operating mechanism 10 in the valve driving chamber 32, is discharged from the opening 33*a* into the valve operating chamber 4, and lubricates the rocker arm and so forth in the valve operating chamber 4.

A push rod passageway 33 allows communication between the valve operating chamber 4 and the valve driving chamber 32. An opening 33*a* allows communication between the push rod passageway 33 and the valve operating chamber 4. The push rod penetrates the push rod passageway 33 to drive the rocker arm in the valve operating chamber 4.

In addition, a protruding wall member 45 is formed in the valve operating chamber 4 to separate oil mist, liquefied oil and so forth from the fluid (oil mist, liquefied oil and blowby gas) flowing from the push rod passageway 33 into the valve operating chamber 4.

A plurality of suction tubes 43 to suck the oil accumulated in the valve operating chamber 4 are provided in the valve operating chamber 4.

The opening 43*a* of each suction tube 43 is arranged in the position near the bottom surface of the valve operating chamber 4 in the crank chamber 5*a* side to suck up the oil from the bottom surface of the valve operating chamber 4 in the crank chamber 5*a* side. Then, the suction tubes 43 are arranged in the corners of the valve operating chamber 4 in order to suck the oil accumulated in the valve operating chamber 4 through any of the suction tubes 43 even if the four-stroke engine 1 is tilted while the valve operating chamber 4 is located in an upper position.

The opening 43*a* of each suction tube 43 opens in the valve operating chamber 4 in the cylinder block 3 side. Then, the suction tubes 43 are connected to a suction passageway 42. The suction passageway 42 is provided in the valve operating chamber 4 in the opposite side to the crank chamber 5*a*. The suction tubes 43 are provided in the valve operating chamber 4 to communicate with the suction passageway 42 and extend to the crank chamber 5*a* side. Both ends of each suction tube 43 are open.

In addition, a plurality of small holes 44 are provided on the suction passageway 42. Therefore, it is possible to suck the oil accumulated in the valve operating chamber 4 through any of the small holes 44 even if the four-stroke engine 1 is tilted to place the valve operating chamber 4 in a lower position.

A direct passageway 46 is provided in the suction passageway 42 to allow communication between the valve operating chamber 4 and the crank chamber 5*a* when a negative pressure is created in the crank chamber 5*a*.

An opening 246*b* of the direct passageway 46 is open in the crank chamber 5*a*. Like the opening 34*a* of the oil feeding passageway 34, this opening 246*b* is positioned such that the opening 246*b* opens as the piston 6 moves from a position near the top dead center to the top dead center. In other words, the opening 246*b* is positioned to open when the skirt part 6*a* which is the lower part of the piston 6 passes over the opening 246*b*.

Therefore, the opening 246*b* of the direct passageway 46 has been fully open at the time the piston 6 arrives at the top dead center.

In addition, a check valve may be provided in the direct passageway 46 which allows oil to flow from the valve operating chamber 4 to the crank chamber 5*a* side and restricts oil from flowing from the crank chamber 5*a* to the valve operating chamber 4 side.

In this way, it is possible to reliably prevent oil or oil mist from flowing backward from the crank chamber 5*a* to the valve operating chamber 4.

One end 48*a* of a breather passageway 48 is open in approximately the central part of the valve operating chamber 4, and the other end of the breather passageway 48 is connected to an air cleaner 50.

The breather passageway 48 is designed to discharge blowby gas to the combustion chamber. The oil mist and the blowby gas in the valve operating chamber 4 are delivered to the air cleaner 50 via the breather passageway 48 and separated into gas and liquid, that is, separated into blowby gas and oil by an mesh mechanism 51*a* of a gas-liquid separator 51 provided in the air cleaner 50.

The one end 48*a* of the breather passageway 48 is open in approximately the central part of the valve operating chamber 4, and therefore even if much oil remains in the valve operating chamber 4, does not easily suck the oil. A check valve 41 is provided in the breather passageway 48 to prevent blowby gas and oil mist from flowing backward from the air cleaner 50 to the valve operating chamber 4 side.

The oil having been subjected to the gas-liquid separation is supplied to the crank chamber 5*a* through a reflux passageway 52 that allows communication between the air cleaner 50 and the crank chamber 5*a*. A check valve 51*b* is provided in the reflux passageway 52 to allow oil to flow only to the crank chamber 5*a* side. Meanwhile, the blowby gas having been subjected to the gas-liquid separation is supplied to the combustion chamber.

That is, the oil circulation pathway of the lubrication apparatus is formed by the communicating passageway 39, the supply passageway 30 (including valve operating mechanism-supply passageway 31 and the push rod passageway 33), the suction tubes 43, the small holes 44, the suction passageway 42, the direct passageway 46, the breather passageway 48, and the reflux passageway 52.

When the four-stroke engine 1 is activated, the pressure in the crank chamber 5*a* changes due to the upward and downward motion of the piston 6. To be more specific, when the piston 6 moves upward, the pressure in the crank chamber 5*a* decreases and tends to be a negative pressure, and, on the other hand, when the piston 6 moves downward, the pressure in the crank chamber 5*a* increases and tends to be a positive pressure.

As the piston 6 moves to the vicinity of the top dead center because the pressure in the crank chamber 5*a* tends to be a negative pressure, the opening 34*a* of the oil feeding passageway 34 starts opening to allow communication between the crank chamber 5*a* and the oil reservoir 7. As a result of this, the negative pressure in the crank chamber 5*a* affects the oil feeding passageway 34.

Even if the four-stroke engine 1 is tilted, the intake part 35 of the oil feeding passageway 34 is positioned below the level of the oil A in the oil reservoir 7, so that the oil A is sucked from the oil reservoir 7 and supplied into the crank chamber 5*a*. At the time the piston 6 arrives at the top dead center, the opening 34*a* has been fully open, and therefore it is possible to allow the negative pressure in the crank chamber 5*a* to substantially affect the oil feeding passageway 34.

As a result, it is possible to sufficiently supply the oil A pumped up below the level of the oil A into the crank chamber 5*a*.

The oil supplied into the crank chamber 5*a* lubricates driving parts such as the piston 6 and the crankshaft. At the same time, the oil is scattered from these driving parts and becomes oil mist. Part of the oil mist adheres to the wall surface of the crank chamber 5*a* and is liquefied again.

When the piston 6 moves downward from the top dead center, the pressure in the crank chamber 5*a* changes to a positive pressure. Therefore, the reed valve 40 opens to allow communication between the crank chamber 5*a* and the oil reservoir 7. Then, the oil mist and the oil in the crank chamber 5*a* with a positive pressure are supplied to the oil reservoir 7 via the communicating passageway 39, so that the pressure in the oil reservoir 7 increases. The oil mist discharged from the communicating passageway 39 collides against the surface of the oil A accumulated in the oil reservoir 7 and the wall surface of the oil reservoir 7, and therefore is liquefied and stored in the oil reservoir 7.

The concentration of the oil mist remaining in the oil reservoir 7, which hit against and rebounded from in the oil reservoir 7, is lower than in the crank chamber 5*a*.

Here, when a positive pressure is created in the crank chamber 5*a*, the oil feeding passageway 34 is blocked so as not to prevent the oil from flowing backward from the crank chamber 5*a* to the oil reservoir 7 due to the action of the check valve 37. Then, the opening 34*a* is closed by the piston 6.

An increase in the pressure in the oil reservoir 7 causes the pressure gradient between the oil reservoir 7 and the valve operating chamber 4, so that the oil mist accumulated in the oil reservoir 7 is supplied to the valve operating chamber 4 via the valve operating mechanism-supply passageway 31 of the supply passageway 30.

In the course of supplying oil mist from the oil reservoir 7 to the valve operating chamber 4, each part of the valve operating mechanism 10 in the valve driving chamber 32 provided in the supply passageway 30 is lubricated. During this period of time, part of the oil mist is liquefied.

The oil mist supplied to the valve operating chamber 4 lubricates the valve operating mechanism 10 provided in the valve operating chamber 4 and is supplied to the crank chamber 5*a* via the direct passageway 46.

Otherwise, in a case of the oil mist supplied into the vale operating chamber 4 is liquefied and remains in the vale operating chamber 4, it is possible to supply the oil into the crank chamber 5*a* due to the effect that the level of negative pressure in the crank chamber 5*a* is high. As a result of this, it is possible to prevent oil from remaining in the valve operating chamber 4.

Therefore, it is possible to prevent oil from flowing out when blowby gas is discharged from the valve operating chamber 4 via the breather passageway 48.

Figure 2:
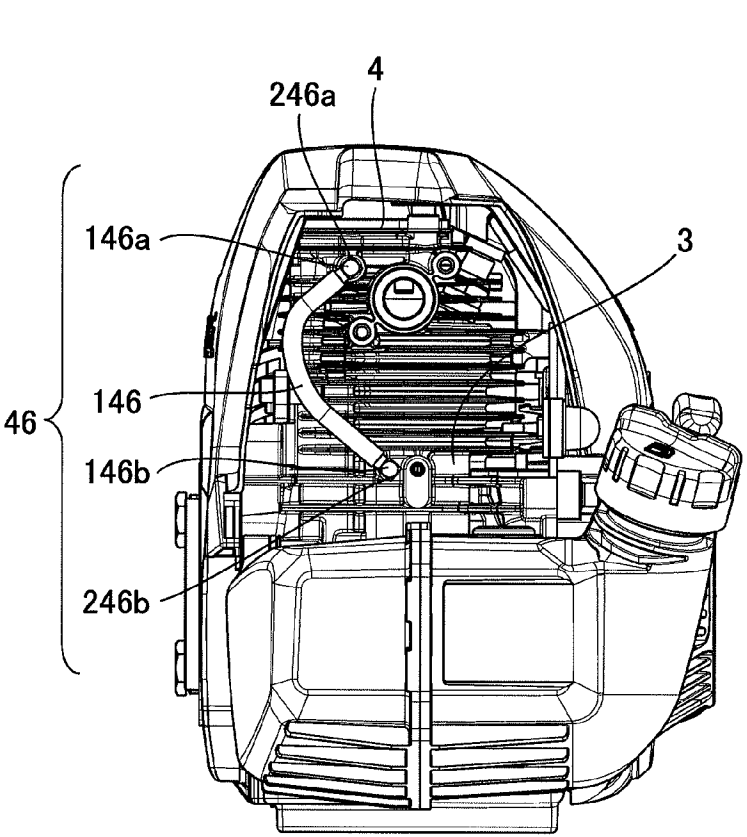
FIG. 2A is an explanatory drawing showing the four-stroke engine including the lubrication apparatus according to the present invention, from behind.
FIG. 2B is an explanatory drawing showing the four-stroke engine including the lubrication apparatus according to the present invention, from the left.
Figure 2:
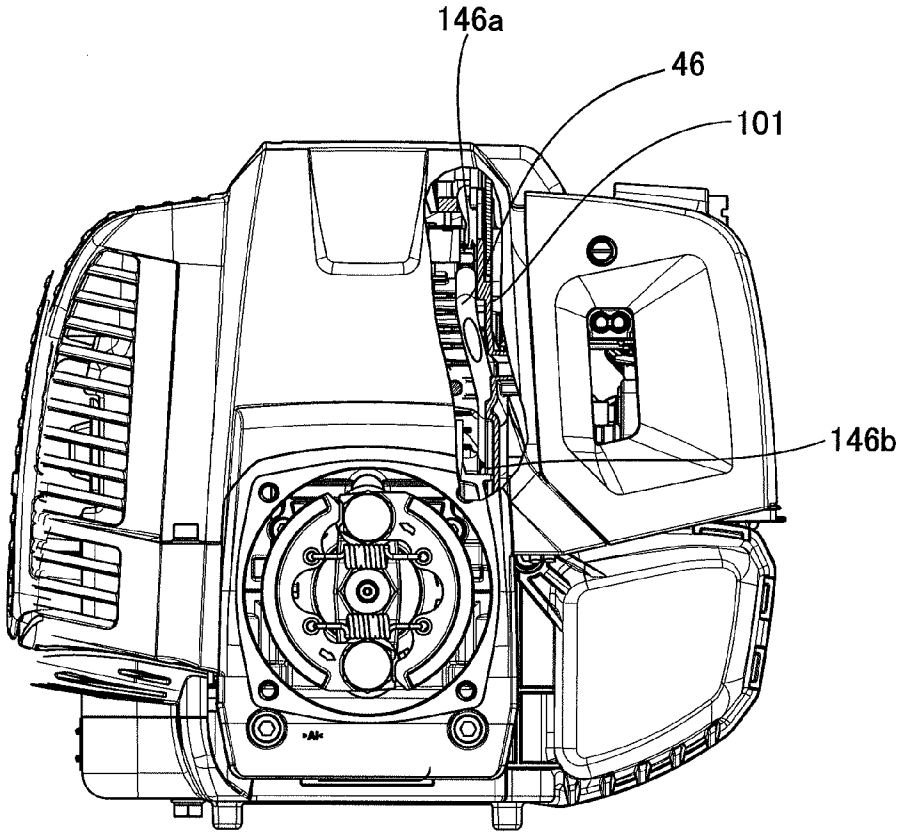

FIG. 2 explains the layout of the direct passageway 46 according to the present embodiment. FIG. 2A is an explanatory drawing showing the four-stroke engine 1 from behind, and FIG. 2B is an explanatory drawing showing the four-stroke engine 1 from the left.

As shown in FIG. 2B, an opening 246*a* is formed in the valve operating chamber 4. This opening 246*a* serves to discharge oil from the valve operating chamber 4.

In addition, an opening 246*b* is formed to recover oil into the crank chamber 5*a*.

A tube 146 is formed of a hose. This tube 146 is flexible or soft, and therefore can be bent. In addition, this tube 146 is made of a heat resisting material which does not deteriorate due to the heat generated by the four-stroke engine 1.

An L-shaped pipe line 146*a* is connected to one end of the tube 146 into which oil flows.

Meanwhile, an L-shaped pipe line 146*b* is connected to the other end of the tube 146 from which oil flows out.

The L-shaped pipe line 146*a* is attached, for example, screwed to the opening 246*a*.

Meanwhile, the L-shaped pipe line 146*b* is attached, for example, screwed to the opening 246*b*.

The direct passageway 46 is formed by the L-shaped pipe line 146*a*, the tube 146, and the L-shaped pipe line 146*b*. As shown in FIG. 1, the L-shaped pipe line 146*a* opens into the suction passageway 42 of the valve operating chamber 4. Meanwhile, the L-shaped pipe line 146*b* opens into the crank chamber 5*a*. Part of the direct passageway 46 is exposed to the outside from the cylinder head 3*a* and also from the cylinder block 3, and the exposed part extends over the outside of the cylinder block 3 as the tube 146.

By providing this tube 146, most of the direct passageway 46 does not pass through the cylinder block 3, so that there is no need to form the direct passageway 46 in the cylinder block 3, and therefore no need to increase the thickness of the cylinder block 3. In addition, there is no need to fabricate a long hole using a drill and do forth to form the direct passageway 46, and therefore it is possible to fabricate the cylinder block 3 for a short period of time and consequently improve the productivity. Moreover, by using the tube 146, the designer can form the opening 246*b* of the direct passageway 46 in the crank chamber 5*a* at any position. By this means, it is possible to improve the flexibility of design. To be more specific, when the interior of the crank chamber 5*a* is not lubricated sufficiently only by the opening 34*a* of the oil feeding passageway 34 configured to flow oil directly from the oil reservoir 7, which opens in the cylinder 3*b*, it is possible to form the opening 246*b* of the direct passageway 46 at any position. In addition, the direct passageway 46 is formed out of the cylinder block 3, and therefore it is possible to prevent oil from being heated by the combustion heat in the cylinder 3. Rather, oil is cooled by forming the direct passageway 46 out of the cylinder block 3, and consequently it is possible to produce a synergistic effect.

Furthermore, the tube 146 is made of a flexible material, so that it is possible to easily change the design of the direct passageway 46. In addition, if the tube 146 has a problem, the tube 146 can be easily replaced.

The tube 146 is provided with the L-shaped pipe line 146*a* and the L-shaped pipe line 146*b* at both ends, respectively, and therefore it is possible to prevent the tube 146 from protruding significantly from the cylinder head 3*a*.

The tube 146 is disposed between the cylinder block 3 and an air guiding cover 101. In this way, the tube 146, which is part of the direct passageway 46 is disposed between the cylinder block 3 and the air guiding cover 101, and therefore it is possible to improve the coolability of the tube 146. This arrangement in which the tube 146 is disposed between the cylinder block 3 and the air guiding cover 101 allows effective utilization of the space between the cylinder block 3 and the air guiding cover 101.

This space between the cylinder head 3*a* and the air guiding cover 101 allows cooling air to pass through to cool the cylinder head 3*a*.

Therefore, when the tube 146 is formed in the space, the tube 146 is cooled effectively, so that it is possible to prevent the tube 146 from being damaged by heat. Moreover, the direct passageway 46 is provided separately, and therefore it is possible to prevent oil from being heated by the four-stroke engine 1. That is, by cooling the tube 146, the oil passing through the tube 146 is cooled.

As described above, with the present embodiment, it is possible to efficiently cool the oil passing through the direct passageway 46.

The opening 246*b* of the direct passageway 46 in the cylinder 3*b* side opens when the piston 6 moves from a position near the top dead center to the top dead center, and closes when the piston 6 moves from a position near the top dead center to the bottom dead center (see FIG. 1). By this means, it is possible to flow oil from the direct passageway 46 to the cylinder 3*b* at an appropriate timing. Moreover it is possible to prevent oil from flowing back to the direct passageway 46.

There are the opening 246*b* of the direct passageway 46 and the opening 52*a* of the reflux passageway 52 in the crank chamber 5*a*. The reflux passageway 52 is configured to flow the oil separated in the air cleaner 50 back to the crank chamber 5*a*. These openings 246*b* and 52*a* are formed on a plane perpendicular to the direction in which the piston 6 slides. By this configuration, it is possible to use the oil from the valve operating chamber 4 which is recovered through the direct passageway 46 to lubricate the piston 6, as well as the oil from the air cleaner 50. In addition, it is possible to recover the oil from the air cleaner 50 and the oil from the valve operating chamber 4 which is recovered through the direct passageway 46, into the crank chamber 5*a* at the same time, and consequently achieve efficient recovery of oil.

<Configuration and Effect of Embodiment>

The lubrication apparatus for a four-stroke engine according to the present embodiment at least includes the piston 6, the cylinder 3*b*, the crank chamber 5*a* and the valve operating chamber 4. The lubrication apparatus for a four-stroke engine is configured to lubricate driving parts while circulating oil mist in the circulation pathway, using pressure fluctuation in the crank chamber 5*a*, which is caused by reciprocating motion of a piston 6. The direct passageway 46 is provided to communicate between the valve operating chamber 4 and the crank chamber 5*a* when a negative pressure is created in the crank chamber 5*a*. The direct passageway 46 has the flexible tube 146 formed out of the cylinder 3*b*. With this configuration, there is no need to fabricate a long hole to form the direct passageway 46, so that it is possible to improve the productivity. In addition, the designer can form the opening 246*b* of the direct passageway 46 in the crank chamber 5*a* at any position. Moreover, it is possible to prevent an increase in temperature of the oil passing through the direct passageway 46. With this configuration, it is possible to easily design, fabricate and manage the direct passageway 46.

The L-shape pipe line 146*a* and L-shape pipe line 146*b* are provided both ends of the tube 146, respectively. With this configuration, it is possible to prevent the tube 146 from protruding significantly from the cylinder head 3*a*.

The opening 246*b* of the direct passageway 46 in the crank chamber 5*a* opens when the piston 6 moves from a position near the top dead center to the top dead center, and closes when the piston 6 moves from a position near the top dead center to the bottom dead center. With this configuration, it is possible to flow oil from the direct passageway 46 into the cylinder 3*b* at an appropriate timing.

The tube 146 of the direct passageway 46 is formed between the cylinder 3*b* and the cooing air cover 101 configured to guide cooling air to cool the cylinder 3*b*.

With this configuration, it is possible to improve the coolability of the tube 146. In addition, the tube 146 is made of rubber and so forth, and therefore it is possible to prevent engine seizure. Moreover, the tube 146 is disposed between the cylinder block 3 and the air guiding cover 101, so that it is possible to use the space between the cylinder block 3 and the air guiding cover 101 efficiently.

The lubrication apparatus further includes the gas-liquid separator 51 and the reflux passageway 52 to flow the oil separated in the gas-liquid separator 51 back to the crank chamber 5*a*. The opening 52*a* of the reflux passageway 52 in the crank chamber 5*a* opens when the piston 6 moves from a position near the top dead center to the top dead center, and closes when the piston 6 moves from a position near the top dead center to the bottom dead center. With this configuration, it is possible to use the oil from the valve operating chamber 4 which is recovered through the direct passageway 46 to lubricate the piston 6, as well as the oil from the air cleaner 50. In addition, it is possible to recover the oil from the air cleaner 50 and the oil from the valve operating chamber 4 which is recovered through the direct passageway 46, into the crank chamber 5*a* at approximately the same time, and consequently achieve efficient recovery of oil.

The invention claimed is:

1. A lubrication apparatus of a four-stroke portable engine, comprising:

a piston;

a cylinder;

a crank chamber; and a valve operating chamber, the lubrication apparatus configured to lubricate driving parts while circulating oil mist through an oil circulation pathway, using pressure fluctuation in the crank chamber, the pressure fluctuation being caused by reciprocating motion of the piston, the lubrication apparatus further comprising a direct passageway configured to allow communication between the valve operating chamber and the crank chamber when a negative pressure is created in the crank chamber, wherein the direct passageway supplies the oil mist in the valve operating chamber to the crank chamber, and wherein the direct passageway includes a flexible tube part that is formed outside of an outer surface of the portable engine.

2. The lubrication apparatus according to claim 1, wherein L-shaped pipe lines are provided at both ends of the tube part, respectively.

3. The lubrication apparatus according to claim 1, wherein an opening of the direct passageway in the crank chamber opens when the piston moves from a position near a top dead center to the top dead center, and closes when the piston moves from a position near the top dead center to a bottom dead center.

4. The lubrication apparatus according to claim 1, wherein the tube part of the direct passageway is formed between the cylinder and an air guiding cover configured to guide cooling air to cool the cylinder.

5. The lubrication apparatus according to claim 3, further comprising:

a gas-liquid separator configured to separate oil mist from blowby gas; and a reflux passageway configured to flow oil separated in the gas-liquid separator back to the crank chamber, wherein an opening of the reflux passageway in the crank chamber opens when the piston moves from a position near the top dead center to the top dead center, and closes when the piston moves from a position near the top dead center to the bottom dead center.

* * * * *